US006694545B1

(12) United States Patent
Renton

(10) Patent No.: US 6,694,545 B1
(45) Date of Patent: Feb. 24, 2004

(54) LIFTING APPARATUS

(76) Inventor: Andrew Lamont Renton, 34 Frogston Road West, Edinburgh EH10 7AJ (GB)

( * ) Notice: Subject to any disclaimer, the term of this patent is extended or adjusted under 35 U.S.C. 154(b) by 0 days.

(21) Appl. No.: 09/979,395

(22) PCT Filed: May 8, 2000

(86) PCT No.: PCT/GB00/01764

§ 371 (c)(1),
(2), (4) Date: Nov. 6, 2001

(87) PCT Pub. No.: WO00/67690

PCT Pub. Date: Nov. 16, 2000

(30) Foreign Application Priority Data

May 7, 1999 (GB) ..... 9910437

(51) Int. Cl.[7] ..... A61G 7/10

(52) U.S. Cl. ..... 5/86.1; 5/81.1; 5/83.1; 5/87.1; 212/901; 414/680

(58) Field of Search ..... 414/680; 212/199, 212/203, 204, 256, 901; 5/81.1 R, 83.1, 85.1, 87.1, 86.1; 254/8 R

(56) References Cited

U.S. PATENT DOCUMENTS 486,412 A * 11/1892 Sawyer ..... 212/199
1,347,430 A * 7/1920 Young ..... 182/129
4,484,366 A * 11/1984 Koontz ..... 5/83.1

OTHER PUBLICATIONS

Arjo Sara (Arjo Mecanaids Ltd) Product brochure with corresponding "Operating Instructions".

* cited by examiner

*Primary Examiner*—Donald W. Underwood
(74) *Attorney, Agent, or Firm*—Alston & Bird LLP

(57) ABSTRACT

The invention provides a lifting apparatus with variable and independently selectable height and reach which comprises a base supporting a lifting structure. The lifting structure comprising two upwardly extending variably extendible support structures, an arm having a proximal end portion and an intermediate portion, which are pivotally connected to an upper end portion of respective ones of said variably extendible support structures; and a load support structure depending from a distal end portion of the arm. Each of the variably extendible support structure is provided with drive control for extending and retracting each of the variably extendible support structures relative to each other for controlling translational movement of the arm wherein the reach and elevation of the lifting apparatus may be altered by selective extension and/or retraction of each of the variably extendible support structures whereby a load can be selectively and independently moved in vertically and/or horizontally extending directions.

19 Claims, 5 Drawing Sheets

LIFTING APPARATUS

The present invention relates to a lifting apparatus, more particularly a lifting apparatus which is suitable for operating within confined spaces or areas such as between beds in a hospital ward.

Lifting apparatus are used in hospitals and hospices and the like to facilitate movement of patients onto and off of beds, trolleys, wheelchairs and into and out of baths.

In general lifting apparatus of this type take the form of fixed structures located above the bed or bath. The lifting apparatus comprises a mechanically or manually operable pulley system from which depends a harness for securing to a patient during lifting. The pulley system is movable horizontally along rails which are generally fixed to a wall adjacent the bed/bath.

The main disadvantages of lifting apparatus of this type is that they are fixed (to a wall or may be free standing frame secured to the floor) and are not readily relocatable without first dismantling the apparatus, which is obviously undesirable and time consuming.

Mobile lifting apparatus are also used in hospitals to provide support to a patient to be lifted. These generally lift through a single arcuate pathway which presents difficulties in lifting patients onto and off of beds, or trolleys, or into and out of baths.

Lifting aids of this type are generally unsuitable for patients who are unable to grip the lifting apparatus with at least one hand or who lack comprehension and are totally non self-weight-bearing. Furthermore, in use, lifting aids of this type may require one person to operate the lifting aid another provides additional support to the patient.

It is an object of the present invention to minimise or obviate one or more of the foregoing disadvantages.

The present invention provides a lifting apparatus which is capable of variable and independently selectable height and reach and is particularly suitable for use in lifting patients in and out of beds, trolleys, wheelchairs and into and out of baths in hospitals and hospices and the like, which lifting apparatus comprises a base supporting a lifting means, said lifting means comprising at least two upwardly extending variably extendible support means; an arm having a proximal end portion and an intermediate portion, which portions are pivotally connected, directly or indirectly, to an upper end portion of respective ones of said variably extendible support means; and a load support means depending from a distal end portion of the arm, said variably extendible support means being provided with drive control means formed and arranged for extending and retracting said variably extendible support means relative to each other for controlling translational movement of the arm such that the reach and elevation of the lifting apparatus may be altered substantially independently of each other whereby a load depending from the distal end of said arm can be selectively and independently moved in generally vertically and/or horizontally extending directions.

Various forms of drive control means may be used. Conveniently there may be pressurised fluid (hydraulic or pneumatic), single or double-acting, rams provided with drive means such as pressurised fluid pumps and control means such as valve systems. The pressurised fluid rams may moreover have two, three or more concentrically arranged telescopically extendible sections. Additionally, where the pressurised fluid rams have two or more sections, then the ram of one (or more) of said two or more sections can be locked in a desired position by a locking means while the remaining section(s) can be extended and/or retracted as desired. Preferably, at least one of said at least two upwardly extending variably extendible support means is a double-action ram.

Alternatively there may be used rack and pinion or winch and pulley systems with drive means such as an electric motor or a direct drive system such as a linear motor, and control means may be electronic circuit systems. Naturally microprocessor systems may also be included in the control systems. It will be appreciated that the apparatus may be readily provided in different sizes with various operating parameters, notably range of horizontal and vertical movement, and maximum reach and maximum elevation of the load support means. Conveniently the variably extendible support means are formed and arranged to provide a maximum elevation of the load support means in the range of from 1.5 to 3.0 m.

The footprint shape of the base can be of any configuration such as generally circular, polygonal (regular or irregular), e.g. hexagonal, square or triangular. The shape of the base is preferably cylindrical so as to avoid angular edges which may cause an injury to a user or patient.

The base of the lifting apparatus may be provided with powered and/or unpowered wheels or other similar means to facilitate relocation/transportation of the lifting apparatus in a loaded or unloaded condition.

The arm typically has a length of from 0.5 to 2.0 m, preferably from 1.0 to 1.6 m. The arm is desirably fabricated from a material which has a relatively high tensile strength to permit safe lifting of patients with body-weights which may be up to 100 to 150 kg or more. Suitable materials are steel, especially high tensile steel, DURALUMIN (Trade Mark) and other high tensile alloys.

Conveniently there may be provided an extension attachment which is formed and arranged to be connected to the distal end of the arm to provide additional reach. The extension attachment may also be provided with similar support apparatus as for the arm such as a support harness or releasable fastening (such as a karabiner). A similar extension attachment may also be provided for attachment to the uppermost end of each of the variably extendible support means.

It will be appreciated that the base should generally be configured to ensure that the lifting apparatus does not over-balance in use with an intended load. In general the base is formed and arranged so that together with said support means, it provides sufficient counter-balancing for any intended load. Conveniently there may be included in the base counter-weight or ballast means.

The drive control means conveniently is provided with a user interface in the form of a control panel located on the base. Alternatively, the user interface may be a remote control device linked to the variably extendible drive means via suitable wiring or other communication means such as radio, infra-red, or microwave transceivers.

An on-board power pack may conveniently be provided within the base and preferably comprises a system of rechargeable battery power cells. Advantageously, the power pack is provided with an integral charging device such that the battery power cells can be re-charged directly from a mains power supply.

The drive control means is desirably of at least sufficient power to produce a lifting capacity of at least 150 kg, and advantageously 200 kg or more, when the arm is fully extended (and any variably extendible support means is also extended to its maximum extent).

In a preferred form of the present invention, the arm is directly and pivotally connected to the respective upper end portions of the at least two variably extendible support means.

Desirably said at least two variably extendible support means comprise at least one each of a main variably extendible support means and a secondary variably extendible support means whereby the main variably extendible support means provides the main load bearing support for the lifting apparatus.

Preferably, the main variably extendible support means provides the main load bearing support for the arm via a support link which is pivotably connected across the upper end of the main variably extendible support means and said intermediate portion of the arm. The said secondary variably extendible support means is pivotally connected to a proximal end portion of the arm. The height and reach of the lifting apparatus may be varied by altering the degree to which the main and secondary variably extendible support means are extended relative to each other.

In a preferred form of the present invention provided with said support link, the variably extendible support means (main and secondary) and the arm may be retracted and stowed within said base of the lifting apparatus by extending the main variably extendible support means to its fullest extent while simultaneously retracting the secondary variably extendible support means, said arm pivots downwardly about its non-distal end (attached to said upper end portion of the secondary variably extendible support means) to a final resting position where said arm lie flush against along its length against the secondary variably extendible support means such that the main and secondary variably extendible support means and the arm are substantially parallel to each other; both the main and the secondary variably extendible support means may then fully retracted by the drive control means within said base of the lifting apparatus.

When the apparatus does not require the extending arm to be fully retracted, the coupling between the ram and the arm can be of the permanent fixed coupling type. Where it does require to be retracted then a pivot pin connecting the hydraulic ram to the arm, must disconnect from the arm. This may be done in different ways but one preferred way would be to have the jaws of pivot pin engaging catches provided on the arm formed and arranged so that they are forced open under the power of the pin's movement. The jaws may be locked around the pin using a cotter pin and/or heavy duty leaf spring and/or a resiliently biased piston on one (or possible both) side(s) of the pin catch.

Various kinds of support means at the distal end of the arm may be used, including, inter alia, a support harness or the like such as those commonly used in hospitals for lifting patients in and out of wheelchairs, baths, beds and onto/off of trolleys. Alternatively, the support means may be a hook or releasable fastener such as a karabiner for attachment to a support harness or the like.

The base may be supported on a turntable or the like such that the lifting apparatus can be rotated through a full rotation or part thereof. The turntable is conveniently controlled through the same user interface as the drive control means. Additionally or alternatively the lifting apparatus may be provided with a plurality of stabiliser legs or stays which can be extended in use of the apparatus when required to provide additional security against overbalancing. The stabilising legs or rods may be integral parts of the base or turntable or may be connected thereto by conventional means such as by welding or by being bolted into place.

The scope of use of the lifting apparatus is not intended to be strictly limited to use in hospitals and the like, and it is intended that the apparatus may be used in a wide variety of environments such as in warehouses where space is limited or on construction sites where there are frequently relatively heavy loads to be lifted and/or moved.

The present invention will now be further described with particular reference to the following specific examples and drawings which are provided by way of illustration.

Figure 1:
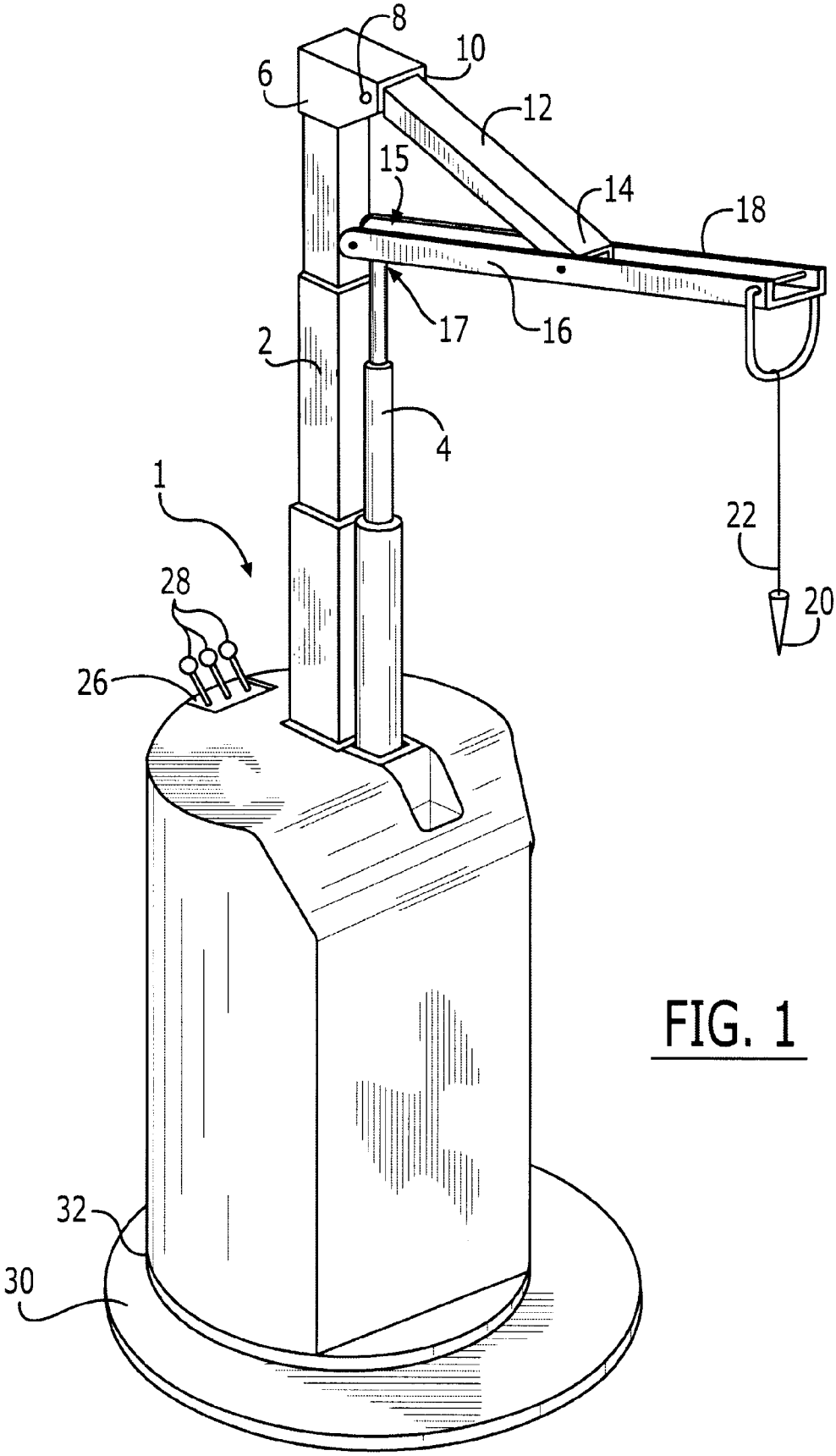
FIG. 1 shows a perspective view of the lifting apparatus according to one preferred aspect of the present invention.

A lifting apparatus as shown in FIG. 1 according to one preferred aspect of the present invention is generally referred to by the reference number 1.

The lifting apparatus 1 has a pair of vertically extending parallel variably extendible support means 2 and 4 which are the main and secondary variably extendible support means respectively. The variably extendible support means 2 and 4 are in the form of three part hydraulically powered rams. The main variably extendible support means 2 is load bearing and is larger in diameter than the secondary variably extendible support means 4 which is substantially non-load bearing. Located at the upper end portion 6 of the main variably extendible support means 2 is a pivot point 8 to which is connected one end 10 of a support link 12. The support link 12 is pivotally connected at its other end 14 to the mid-portion of an arm 16. The proximal end 15 of the arm 16 is pivotally connected 42 to the upper end portion 17 of the secondary variably extendible support means 4. The arm 16 has a distal end 18 from which depends a load 20 suspended by a wire cable 22. Where the load is a patient, the patient may be secured by a patient support harness 23, shown in the outline.

The variably extendible support means 2 and 4 extend vertically from the top of a substantially cylindrical body portion 24 of the lifting apparatus 1. The front (adjacent and facing the load to be lifted) of the body portion 24 is planar and thereby provides a greater area for manoeuvring of a load to be lifted and/or moved.

A control panel 26 located on the upper rearward facing portion of the body portion 24. The control panel 26 has two control levers 28 for use in controlling the operation and movement of the lifting apparatus 1.

The body portion 24 is supported on and rotatably connected to a circular base section 30 via a turntable 32. The base section has a larger footprint area that the body portion 24 resting thereon so as to provide stability to the lifting apparatus 1 during lifting operations.

Figure 2:
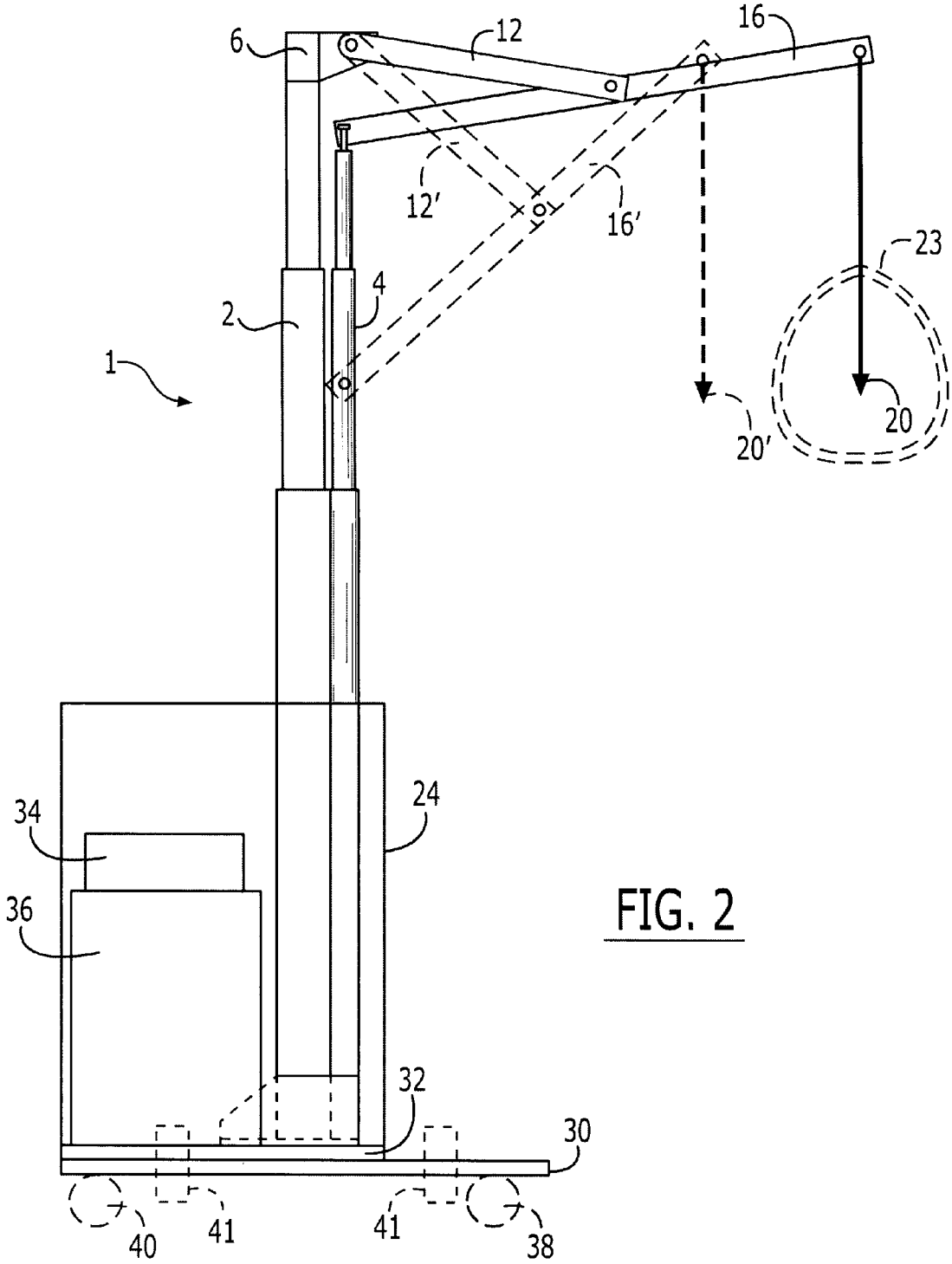
FIG. 2 shows a side view of the apparatus similar to that of FIG. 1.
Figure 2A:
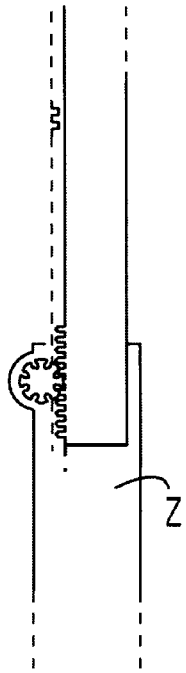
Figure 2B:
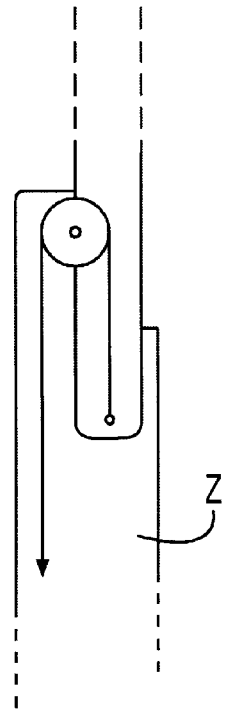
Figure 8:
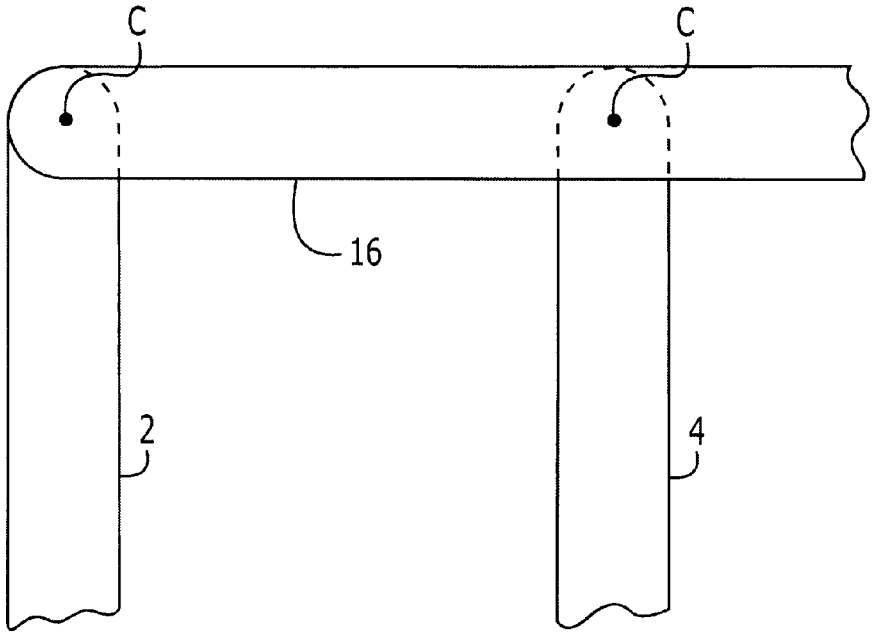
FIG. 8 illustrates an arm 16 directly and pivotally connected (c) to the respective upper portions of the at least two variable support means 2, 4.

In order to show a change in the reach of the lifting apparatus without any change in the height of the load 20, FIG. 2 shows the relative starting positions of the arm 16 and the support link 12 as indicated by solid lines (the dashed lines and reference numerals 12', 16' and 20' relate to the support link, the arm and the load respectively in their final relative positions). The reach of the lifting apparatus is reduced without changing the height of the load 20 supported, by retracting the secondary variable extendible support means 4 while the primary variable extendible support means 2 is not moved. The load 20 is move closer to the body portion 24 of the lifting apparatus 1.

Battery power pack 34 resting upon a hydraulic power unit 36 is located within the body portion 24. The battery power pack and hydraulic power unit are formed and arranged conventionally (not shown) to provide power to the lifting apparatus 1.

Wheels 38, 40 located under the base section 30 are shown in dashed outline in FIG. 2. The wheels 40 are steerable and are operated (from the control panel 26, FIG. 1) by electric motors (not shown) which are powered electrically from the battery power pack 34 and are provided with brakes (also not shown). The base section 30 is provided with retractable stabilizer legs or stays 41 shown in outline, which can be deployed in use of the apparatus when required to provide additional security against overbalancing.

Figure 3:
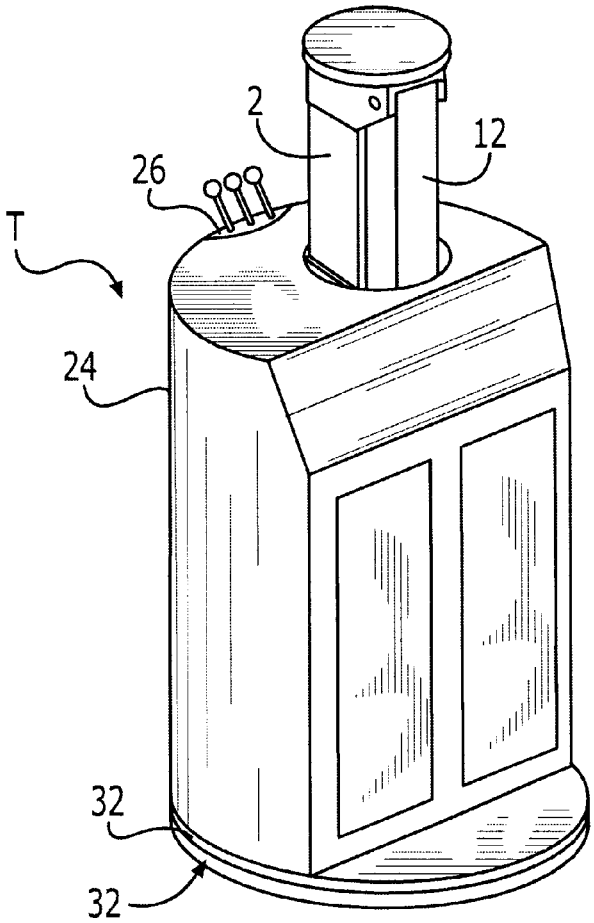
FIG. 3 illustrates the retractable nature of the lifting means.

The primary and secondary variably extendible support means 2 and 4 are shown in a partially retracted state within the body section 24 such that the arm 12 (FIG. 3) abuts along its length against the primary variably extensible support means 2. The primary and secondary variably extendible support means 2 and 4 and the arm 12 can then be fully withdrawn inside the body portion 24.

Figure 4:
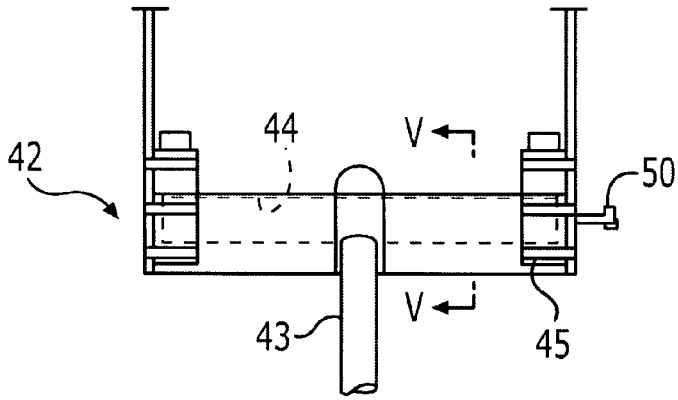
FIG. 4 is a schematic detail vertical section through the pivotal connection of the arm to the secondary extensible support.
Figure 5:
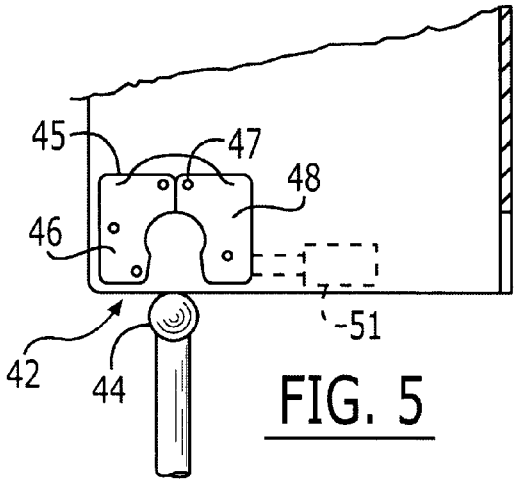
FIGS. 5 and 6 are transverse sections corresponding to FIG. 4 showing complete and partial disengagement thereof, respectively.
Figure 6:
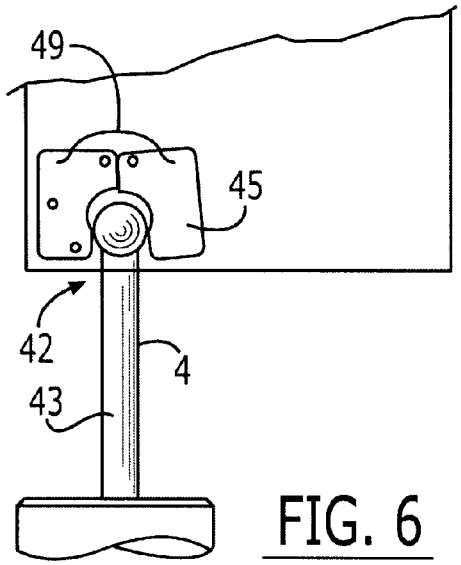

FIGS. 4 to 6 show some preferred forms of pivotal connection 42 of the arm 16 to the secondary variably extendible support means 4. In more detail the upper end 43 of the secondary variably extendible support means 4 has a transversely extending pivot pin 44 which is captively engaged at each end in a pin catch 45. Each pin catch 45 comprises a fixed jaw 46 and a hinged 47 jaw 48, which is biased into a closed position by a strong leaf spring 49. The opposed inner faces 50 of the jaws 46, 48 are shaped so that the pivot pin 44 can be driven from a fully disengaged position shown in FIG. 5, inbetween the jaws 46, 48, forcing them apart as shown in FIG. 4 allowing the jaws 46, 48 to close together around it under the influence of the leaf spring 49. Similarly the pivot pin 44 can be pulled out from between the jaws 46, 48 when the arm 16 is held in its collapsed condition by the fully extended main extendible support 2 while the secondary variably extendible support 4 is fully retracted.

In order to ensure against any unintentional disengagement of the pivotal connection 42 in use of the apparatus for lifting or lowering of a load, the pin catch 45 is desirably provided with a locking mechanism to secure the hinged jaw 48 in its closed position. Thus, for example, there may be used a removable or retractable locking pin 50, or a small piston and cylinder device 51 which is extended against the outside of the jaw 48 to prevent opening thereof.

Figure 7:
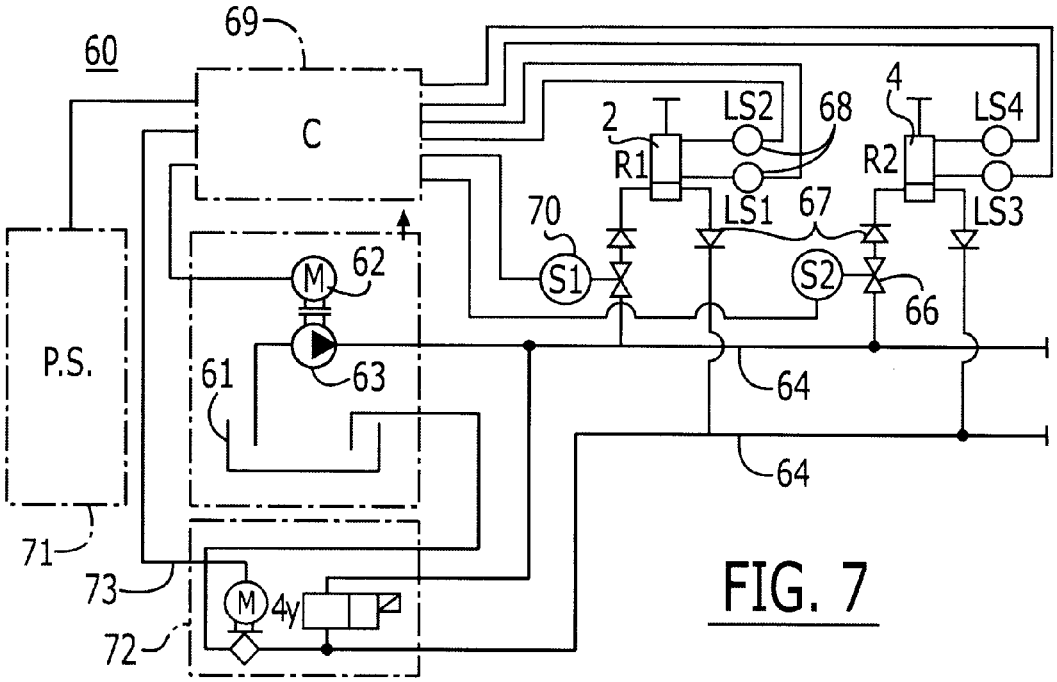
FIG. 7 is a schematic hydraulic circuit suitable for an apparatus of the invention.

FIG. 7 is a schematic circuit diagram of a hydraulic circuit 60 suitable for use in operation of the variably extendible support rams 2, 4. The circuit comprises a reservoir 61, electrically driven 62 pump 63, supply and return lines 64, 65, connected to the variably extendible support rams 2,4 via supply valves 66, and non-return valves 67. The rams 2,4 are provided with limit switches 68 which are connected to an electrical control panel 69 along with actuators 70 for the supply valves 66. An electrical power supply 71 is also connected via the control panel 69 the pump motor 62. A cooler 72 is included in the hydraulic circuit 60 to prevent overheating of the pressurised fluid and is also provided with electrical connections 73 to the control panel 69 for controlling operation thereof.

It will be appreciated that various modifications may be made to the above-described embodiments without departing from the scope of the present invention. Thus, for example, one or both of the single-acting rams 2, 4 in FIG. 7 could be replaced by double-acting rams.

Various modifications may be made to the above described embodiments without departing from the scope of the present invention.

What is claimed is:

1. A lifting apparatus with variable and independently selectable height and reach which lifting apparatus comprises a base supporting a lifting means, said lifting means comprising at least two upwardly extending variably extendible support means; an arm having a proximal end portion and an intermediate portion, which portions are pivotally connected, directly or indirectly, to an upper end portion of respective ones of said variably extendible support means; and a load support means depending from a distal end portion of the arm, each of said at least two variably extendible support means being provided with drive control means formed and arranged for extending and retracting each said variably extendible support means relative to each other for controlling translational movement of the arm wherein the reach and elevation of the lifting apparatus may be altered substantially independently of each other by selective extension and/or retraction of each said variably extendible support means whereby a load depending from the distal end of said arm can be selectively and independently moved in generally vertically and/or horizontally extending directions.

2. A lifting apparatus s claimed in claim 1 wherein said drive control means are in the form of pressurized fluid rams provided with drive means for extending and/or retracting the rams.

3. A lifting apparatus as claimed in claim 1 wherein said drive control means are in the form of a mechanical system selected from: a rack and pinion system, and winch and pulley systems, each said mechanical system being provided with drive means and control means.

4. A lifting apparatus as claimed in claim 1 wherein the variably extendible support means are formed and arranged to provide a maximum elevation of the load support means in the range of from 1.5 to 3.0 m.

5. A lifting apparatus as claimed in claim 1 wherein the base of the lifting apparatus is provided with powered and/or unpowered wheels, or other ground engaging means formed and arranged to facilitate relocation of the lifting apparatus.

6. A lifting apparatus as claimed in claim 1 wherein the arm has a length of from 0.5 to 2.0 m.

7. A lifting apparatus as claimed in claim 1 wherein the footprint of the base is formed and arranged so as to extend substantially underneath the centre of gravity of the apparatus when said arm is loaded with a predetermined maximum load.

8. A lifting apparatus as claimed in claim 1 wherein said drive control means has a user interface in the form of a control panel located on the base and/or a remote control device coupled to the variably extendible drive means.

9. A lifting apparatus as claimed in claim 1 wherein the variably extendible support means drive control means is formed and arranged to provide a maximum lifting capacity in the range from 150 to 250 Kg when the arm is fully extended.

10. A lifting apparatus as claimed in claim 1 wherein the arm is directly and pivotally connected at said proximal portion and said intermediate portion to the respective upper end portions of the at least two variably extendible support means.

11. A lifting apparatus as claimed in claim 1 wherein said at least two variably extendible support means comprise at least one each of a main variably extendible support means and a secondary variably extendible support means whereby the main variably extendible support means provides the main load bearing support for the lifting apparatus.

12. A lifting apparatus as claimed in claim 11 wherein the main variably extendible support means provides the main load bearing support for the arm via a support link which is pivotably connected for the arm via a support link which is pivotably connected across the upper end of the main variably extendible support means and said intermediate portion of the arm; and the said secondary variably extendible support means is pivotally connected to a proximal end portion of the arm, via an arm end portion pivotal connection, the height and reach of the lifting apparatus being adjustable by altering the degree to which the main and secondary variably extendible support means are extended relative to each other.

13. A lifting apparatus as claimed in claim 12 wherein said arm end portion pivotal connection means is formed and arranged so as to be selectively disconnectable so that, in use of the apparatus, the main and the secondary variably extendible support means and the arm may be retracted and stowed within said base of the lifting apparatus: by extending the main variably extendible support means to its fullest extent while simultaneously retracting the secondary variably extendible support means so that said arm pivots downwardly about its proximal end which is attached to said upper end portion of the secondary variably extendible support means to a collapsed position wherein said arm lies along side the secondary variably extendible support means with the main and secondary variably extendible support means and the arm substantially parallel to each other; said arm end portion pivotal connection being disconnected to allow each of the main and the secondary variably extendible support means and arm to be fully retracted by the drive control means within said base of the lifting apparatus.

14. A lifting apparatus as claimed in claim 13 wherein said selectively disconnectable arm end pivotal connection means comprises pivot pin means and pin catch means having jaws provided with resilient biasing means for urging said jaws towards each other into a substantially closed position for captive engagement around said pivot pin means, said jaws being formed and arranged so that at least one is displaceable towards an open position by driving of the pivot pin means into or out of engagement with said pin catch means and said pin catch means being provided with locking means formed and arranged for locking said jaws into their closed position at least during use of the apparatus for lifting or lowering of a load.

15. A lifting apparatus according to claim 14 wherein said base is provided with guide means formed and arranged for guiding engagement with said proximal arm end: upon retraction of said arm into the base following disengagement of said pivot pin from said catch means, so as to laterally displace said arm for stowage thereof alongside said secondary variable extendible support means; and upon deployment of said arm out of said base so as to restore said pivot pin into a pin catch means—engaging position for engagement therewith upon extension of the secondary variably extendible support means out of the base.

16. A lifting apparatus according to claim 14 wherein said base is provided with a latching/unlatching device formed and arranged for actuation of said pin catch locking means so as to allow opening thereof to permit opening of said jaws for disengagement or engagement of the pin means with the pin catch means when said variably extendible support means and said arm are fully retracted into the base or extended out therefrom.

17. A lifting apparatus as claimed in claim 1 wherein said load support means at the distal end of the arm comprises a patient support harness.

18. A lifting apparatus as claimed in claim 1 wherein the base is supported on a turntable for rotation of the lifting apparatus through at least 90° C.

19. A lifting apparatus as claimed in claim 1 wherein the lifting apparatus is provided with a plurality of retractable stabiliser legs or stays which can be deployed in use of the apparatus when required to provide additional security against overbalancing.

* * * * *